US005966769A

United States Patent [19]

Tortorice

[11] Patent Number: 5,966,769

[45] Date of Patent: Oct. 19, 1999

[54] TOOTHBRUSH WITH FILLABLE, INTERCHANGEABLE, HOLLOW HANDLE

[76] Inventor: Laurie P. Tortorice, 1715 Cochran St., Apt. C, Simi Valley, Calif. 93065

[21] Appl. No.: 09/022,827

[22] Filed: Feb. 12, 1998

[51] Int. Cl.[6] ..... A46B 9/04

[52] U.S. Cl. ..... 15/105; 15/143.1; 15/145; 15/167.1; 15/176.1; 446/267

[58] Field of Search ..... 15/167.1, 105, 15/143.1, 145, 176.1; 446/71, 73, 74, 219, 267; 433/216

[56] References Cited

U.S. PATENT DOCUMENTS

| | | | |
|---|---|---|---|
| D. 343,519 | 1/1994 | Booth et al. | D4/104 |
| 2,306,482 | 12/1942 | Livingston | 15/167.1 |
| 4,600,974 | 7/1986 | Lew et al. | 362/102 |
| 5,009,341 | 4/1991 | Broxton | 222/130 |
| 5,135,591 | 8/1992 | Vockel, Jr. et al. | 156/67 |
| 5,264,267 | 11/1993 | Wang | 428/76 |
| 5,269,717 | 12/1993 | Tardif | 446/74 |
| 5,291,674 | 3/1994 | Torrence | 446/267 |
| 5,361,446 | 11/1994 | Rufo | 15/167.1 |
| 5,431,615 | 7/1995 | Correll | 482/108 |

FOREIGN PATENT DOCUMENTS 909688 3/1954 Germany .

*Primary Examiner*—Mark Spisich
*Assistant Examiner*—Theresa T. Snider
*Attorney, Agent, or Firm*—William W. Haefliger

[57] ABSTRACT

The present invention relates to a decorative toothbrush, which will encourage children to brush their teeth more frequently. The brush includes a brush component and handle component. The handle component, in the preferred embodiment, is constructed from a transparent, plastic material. A decorative fluid is placed within the hollow interior of the handle component.

A variety of decorative fluids are disclosed for use within the handle. One such fluid contains a plurality of phosphorescent characters, which are suspended within a glycerin-water mixture.

In an alternative embodiment, the brush and handle components are releasably interconnected. The two-component nature of the alternative embodiment allows multiple handles to be used with the same brush component. In this way, a user can collect various handle components featuring different characters.

10 Claims, 2 Drawing Sheets

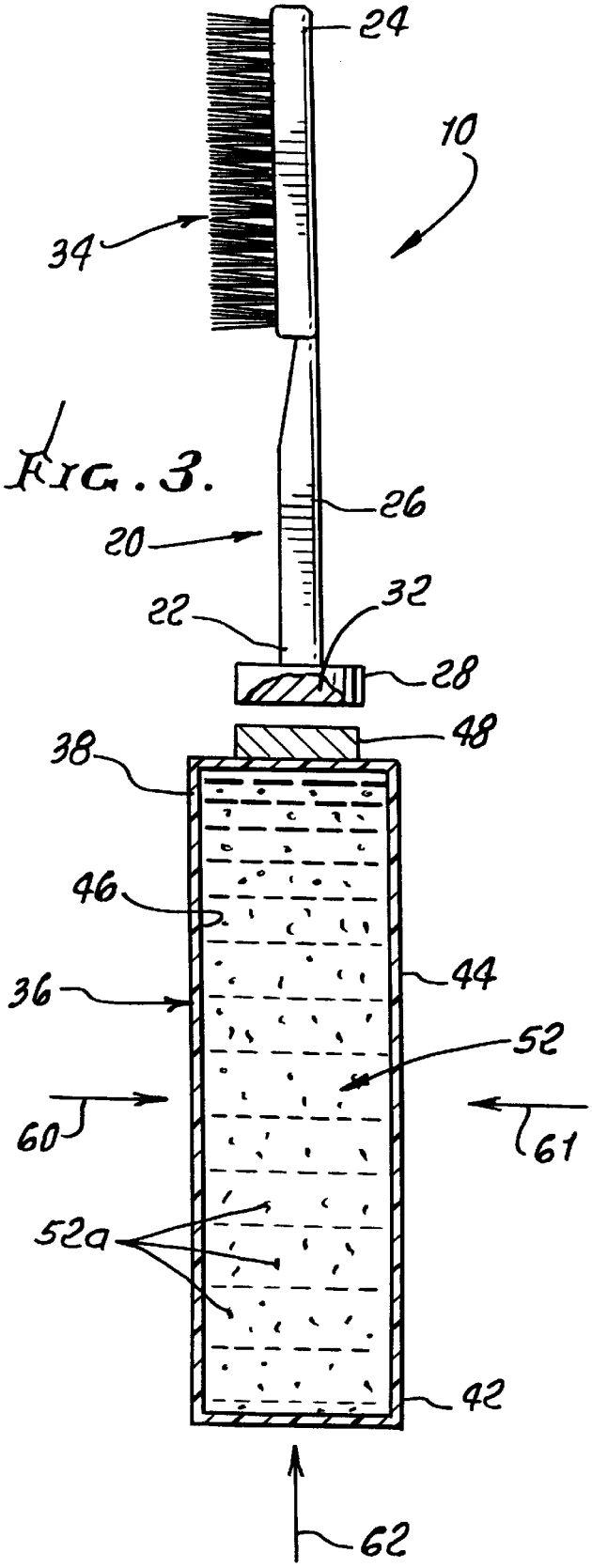
FIG. 3.
FIG. 4.
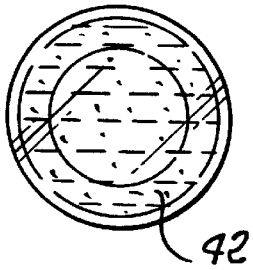
FIG. 5.
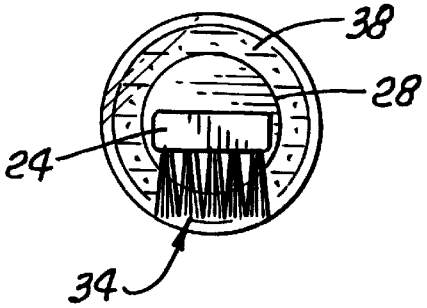
FIG. 3a.
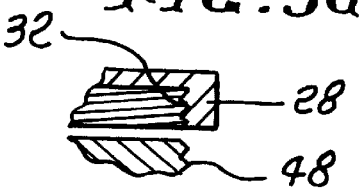

TOOTHBRUSH WITH FILLABLE, INTERCHANGEABLE, HOLLOW HANDLE

BACKGROUND OF THE INVENTION

The present invention relates to a toothbrush; and more particularly pertains to a decorative toothbrush for encouraging children to brush their teeth.

Toothbrushes have a construction generally including a handle portion and an opposed brushing portion. The brushing portion generally consists of a series of upstanding bristles. Furthermore, novelty items employing glittering particles are also known in the prior art. For example, U.S. Pat. No. 5,264,267 to Wang discloses a utensil with a glittering handle. Additionally, U.S. Pat. No. 5,009,341 to Broxton discloses a decorative condiment shaker. The shaker includes a decorative ring, which is preferably hollow and contains liquid and glitter.

U.S. Pat. No. 4,600,974 to Lew et al. discloses an optically decorated baton. The baton is liquid filled, and suspended particles with light-reflecting surfaces, are included therein.

U.S. Pat. No. 5,431,615 to Correll discloses a hand-held fitness device filled with both colored glitter and foam pellets.

Lastly, U.S. Pat. No. 5,135,591 to Vockel, Jr. et al. discloses a process for making a phosphorescent plastic article.

In this respect, the decorative toothbrush of the present invention substantially departs from the conventional concepts and designs of the prior art.

SUMMARY OF THE INVENTION

In view of the foregoing disadvantages inherent in the known types of decorative articles now present in the prior art, the present invention provides a toothbrush having a decorative handle. As such, the general purpose of the present invention, which will be described subsequently in greater detail, is to create an improved toothbrush, which will encourage rapid brushing and frequency of such.

To attain this, the device of the invention includes a brush component and handle component, which are joined or interconnected. The handle component, in the preferred embodiment, is constructed from a transparent, plastic material. A decorative fluid is placed within the hollow interior of the handle component. A variety of decorative fluids are disclosed for use within the handle. One such fluid contains a plurality of phosphorescent small elements or characters, which are suspended or dispersed within a glycerin-water mixture. Such light-transmitting elements move about and variably transmit light, i.e., "sparkle", during toothbrush use, to signify the intensity of use. The two-component nature of the brush may enable multiple replacement handles to be used with the same brush component. In this way, a user can collect various handle components featuring different characters.

There has thus been outlined, rather broadly, certain important features of the invention, in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, method and systems for carrying out the several purposes of the present invention. It is important, therefore, that the claims be regarded as including such equivalent constructions, insofar as they do not depart from the spirit and scope of the present invention.

It is therefore an object of the present invention to provide an unusual and improved decorative toothbrush for use in encouraging children to brush their teeth. In one embodiment, the toothbrush includes a brush component having a proximal end, a distal end and an intermediate extent therebetween. The distal end may have a planar rectangular configuration and may taper downward to the intermediate extent. A series of bristles are secured to, and extending upward from, the planar rectangular distal end of the brush part.

The toothbrush also includes a handle component, which may be cylindrical. It has a proximal end, a distal end and an intermediate extent therebetween. The handle component is typically constructed from a transparent, plastic material and has a hollow interior portion.

A coupling portion may be provided integrally with the proximal end of the handle component. This coupling portion is adapted to be coupled to a coupling portion of the brush component. In this manner the proximal end of the brush component and the proximal end of the handle component are coupled to one another, and such coupling may be provided by threadable interengagement of the coupling portions in or on the brush and handle components.

Lastly, a decorative fluid is located within the hollow interior of the handle component. This decorative fluid typically contains a plurality of light-transmitting small elements suspended in water or a water-glycerin mixture, to move about. Such elements may be iridescent, light reflecting, luminous, or phosphorescent.

It is another object of the present invention to provide a toothbrush with a decorative handle to encourage frequent use of the toothbrush. Agitation of the elements or particles in the liquid or fluid increases with an increase in reciprocating frequency of brushing, to encourage rapid brushing, and transmission of light by the elements or particles varies as they move about, the "sparkling" effect increasing with increasing frequency of brush reciprocation.

It is a further object of the present invention to provide a toothbrush with a decorative and detachable handle, to encourage the collection of various decorative handles.

An even further object of the present invention is to create a toothbrush which is susceptible of low-cost manufacture with regard to both materials and labor, and which accordingly is then susceptible to low sale price to the consuming public, thereby making such toothbrushes economically available or attractive to the buying public.

Still another object of the present invention is to create a handle, which employs a number of phosphorescent elements or particles suspended within a fluid medium.

The method of using the toothbrush having a stem, toothbrushing bristles on the stem, and a hollow container on the stem, the container having a transparent wall, there being liquid in the hollow container and decorative, dispensable elements suspended in the liquid, including:

a) reciprocating the stem to reciprocate the bristles and the liquid during toothbrushing, b) the reciprocating effected at a frequency to effect dispersement of the elements in the liquid, and varying light transmission, to be visible through the wall, c) and observing such varying light transmission from the elements moving in dispersed condition, via the transparent wall.

These, together with other objects of the invention, and along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

These and other objects and advantages of the invention, as well as the details of an illustrative embodiment, will be more fully understood from the following specification and drawings, in which:

DRAWING DESCRIPTION

FIG. 3 is an alternative embodiment of the toothbrush wherein the handle and brush components are threadably interconnected; and FIG. 3*a* shows threading;

FIG. 4 is a top view down the axis of the toothbrush; and

FIG. 5 is a bottom view up the axis of the toothbrush.

Similar reference characters refer to similar parts throughout the several views of the drawings.

DETAILED DESCRIPTION OF THE PREFERRED EMBODIMENT

The present invention relates to a decorative toothbrush, which will encourage children to brush their teeth more frequently and with vigor. The brush includes a brush component and handle component. The handle component, in the preferred embodiment, is constructed from a transparent, plastic material. A decorative fluid is positioned within the hollow interior of the handle component.

A variety of decorative fluids are disclosed for use within the handle. One such fluid contains a plurality of light-transmitting small elements or characters, which are suspended within a glycerin-water mixture, and which are dispersed and move about during agitation of the fluid caused by rapid reciprocating brushing movement of the handle or stem, so as to be variably and movingly visible, as will appear.

In an alternative embodiment, the brush and handle components are interconnected, as for example by threaded coupling. The threaded two-component nature of this alternative embodiment allows multiple handles to be used with the same brush component. In this way, a user can collect various handle components that feature different visible characters in the liquid. The various components of the present invention, and the manner in which they interrelate, will be described in greater detail hereinafter.

Figure 1:
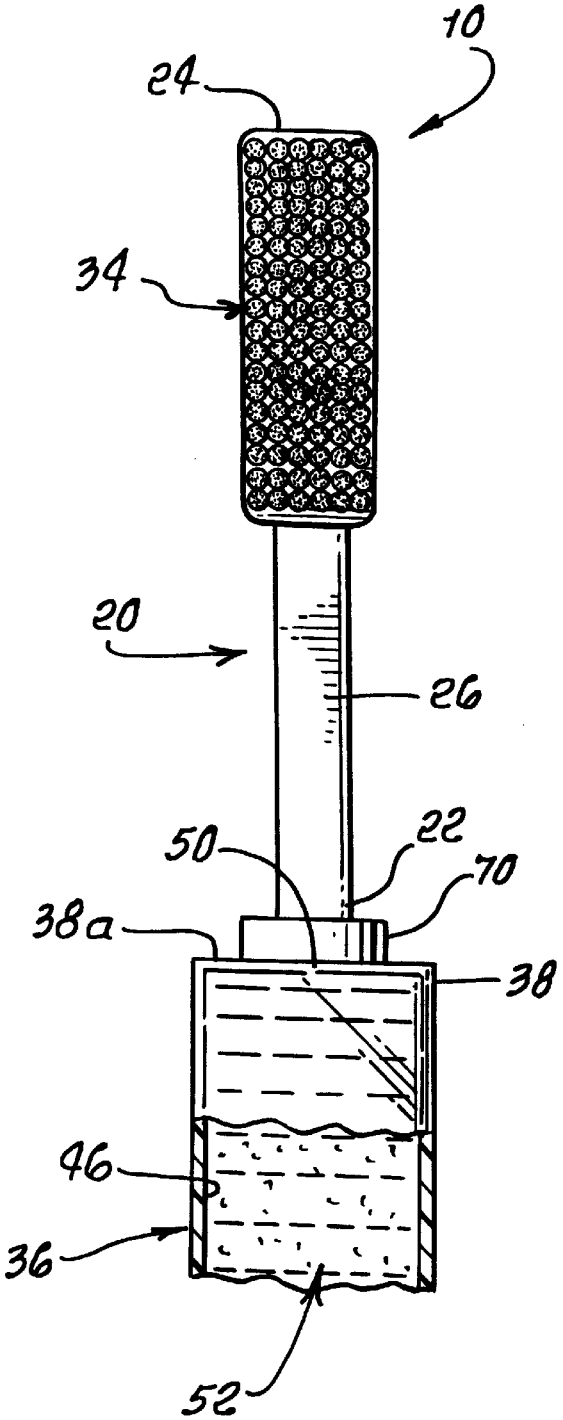
FIG. 1 is a top plan view of the primary embodiment of the toothbrush of the present invention.
Figure 2:
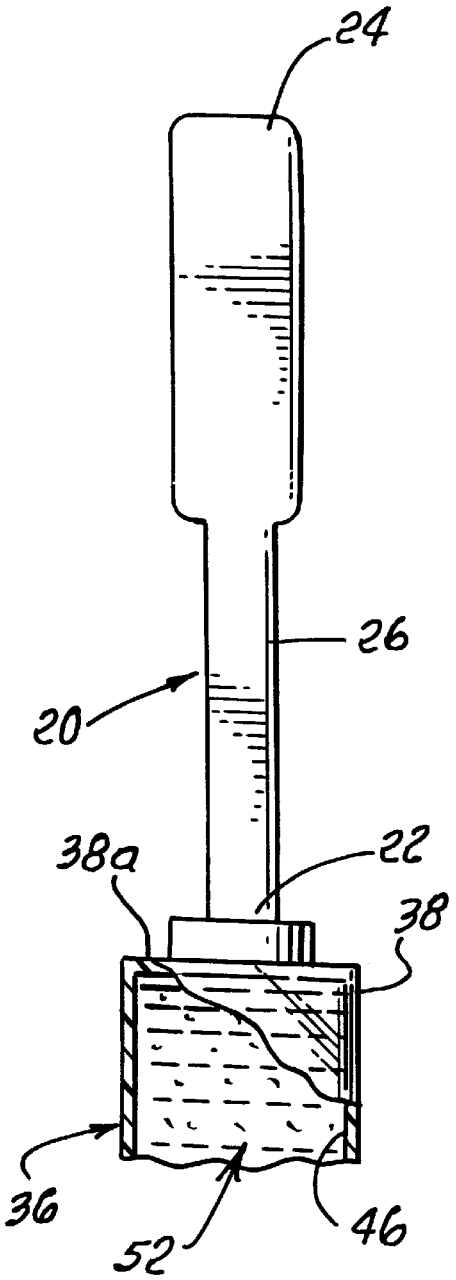
FIG. 2 is a bottom plan view of the primary embodiment of the toothbrush.

FIGS. 1 and 2 illustrate the primary embodiment of the toothbrush of the present invention. Specifically, the toothbrush 10 includes a brush component 20 and a handle component 36, which, in FIG. 1, are shown connected to one another at 50. The brush component 20, in turn, includes a number of bristles 34 at its distal end 24. Additionally, the handle component 36 includes a hollow interior 46 into which a decorative fluid 52 is placed. Two embodiments for this decorative fluid 52 are disclosed hereinbelow.

With reference to FIG. 3, one alternative embodiment of the toothbrush 10 is depicted. Brush component 20 is defined by a proximal end 22, a distal end 24 and an intermediate extent 26 therebetween. The distal end 24, in turn, is defined by a planar rectangular configuration. Furthermore, the intermediate extent tapers toward distal end 24. Additionally, a cylindrical cap portion or enlargement 28 is formed integrally with the proximal end 22 of the brush component 20.

With reference to FIG. 3*a,* the cap may have interior threading at 32. The function of this threaded cap portion 28 will be described in greater detail hereinafter.

In a manner known in the art, a series of bristles 34 are secured to, and extend outward from, the planar rectangular distal end 24 of the brush component 20. Additionally, the bristles 34 themselves may have a conventional construction.

The cylindrical handle component 36 is defined by a proximal end 38, a distal end 42 and an intermediate extent 44 therebetween. As with the primary embodiment, the entire handle component 36 is constructed or molded from a transparent, plastic material. Although plastic has been described, other rigid, transparent materials will suffice. The handle component 36 is further defined by a hollow, interior portion 46. A thickened support 70 integrally connects end 22 of the stem extent 26 to the end wall 38*a* of the handle.

With reference to FIG. 3, the threaded coupling portion 48 of the handle is depicted. This coupling portion 48 may be formed integrally with the proximal end 38 of the handle component 36, and is adapted to be rotatably coupled within the coupling portion or cylindrical cap 28 of the brush component 20. In this fashion, the proximal end 22 of the brush component 20 and the proximal end 38 of the handle component 36 may be quickly coupled to one another. Other than the threaded interconnection between the brush and handle components, the toothbrush of the primary and alternative embodiments are identical.

The decorative nature of the toothbrush is achieved through the decorative fluid 52 which is positioned within the hollow interior 46 of the handle component 36. The two embodiments of this fluid 52 are described hereinbelow.

DECORATIVE FLUID PRIMARY EMBODIMENT

In a primary embodiment, the decorative fluid 52 includes a plurality of phosphorescent elements 52*a* which are suspended in water. These elements can take any number of forms. For example, the elements can be in the form of playing card symbols, musical notes, fish, coins, boats, cars, hearts, crosses, and anchors. As indicated in the primary embodiment, these elements are phosphorescent. Namely, the elements are coated with a material having a phosphorescent pigment added thereto.

Alternatively, the elements could be molded from a phosphorescent material. However, whether coated or molded, the phosphorescent elements are three-dimensional in shape and of a very small size capable of being dispersed and moving about in the liquid or fluid 52 upon rapid reciprocation of the toothbrush, as during use. As the elements or particles are thereby moved about, or tumble, they variably transmit light in an observer's eye direction.

The phosphorescent pigments preferably used are sulfides, such as zinc sulfide, calcium sulfide, strontium sulfide, cadmium sulfide, barium sulfide, and magnesium sulfide. Phosphorescent vinyl is also a suitable material. All of the above-described materials are lightstorage materials. Lightstorage materials are adapted to absorb and store light energy when excited by a natural or artificial light source. Once excited, the lightstorage materials will gradually and continuously release absorbed energy in the form of visible rays for a period of time, even after the exciting source is removed. This is what gives these phosphorescent materials their "glow in the dark" characteristic.

Additionally, because the elements employed are designed to be three-dimensional in shape, once excited, they will release energy in all directions. In this manner, energy can be released through the transparent proximal end 38 of the handle component 36. Note FIG. 5. Their dispersal in the liquid enhances light transmission in all directions, the moving elements variably transmit light to be highly visible, as viewed from directions 60, 61, 62 as seen in FIG. 3, upon sufficient agitation.

Additionally, although the elements have been described as being suspended in water, other fluids or liquids can be employed. For example, a water-glycerin mixture can be employed. The addition of glycerin increases the thickness of the fluid. Thickening the fluid in this manner has the effect of decreasing the speed with which the elements travel in the fluid, so that once dispersed, they tend to remain dispersed, i.e., move slowly from dispersed condition.

Lastly, a saline solution can be employed for suspending the elements. Saline has the added benefit of killing any organisms, which may otherwise be present within the fluid.

Regardless of the fluid medium employed, a coloring agent can be included. The coloring agent can be any of several FDA (Food and Drug Administration) approved food dyes. In this manner, the phosphorescent elements can be suspended within a colored fluid. In the preferred embodiment, a light-colored fluid is used, such as yellow or light blue, in order that the luminesce of the elements is not hidden.

DECORATIVE FLUID SECONDARY EMBODIMENT

The secondary embodiment of the decorative fluid employs a plurality of reflective elements suspended in water. As described in conjunction with the primary embodiment, these elements can take the form of playing card symbols, musical notes, fish, coins, boats, or cars. In this secondary embodiment, however, the elements of particles, are formed of a metallic material, which serves to reflect light. These reflective elements can be suspended within water or a water-glycerin mixture in a manner described in conjunction with the primary embodiment. Furthermore, the reflective elements can be suspended within a saline solution. Lastly, as with the phosphorescent elements, the reflective elements can be suspended within a colored fluid.

DECORATIVE FLUID THIRD EMBODIMENT

The light-transmitting elements may alternatively comprise iridescent particles, such as glitter particles, suspended in water. Such particles are, for example, produced and sold by Mark Enterprises, Newport Beach, Calif., and identified by No. 97-149.

As to the manner of usage and operation of the present invention, the same should be apparent from the above description. Accordingly, no further discussion relating to the manner of usage and operation will be provided.

The method of use includes the steps:

a) reciprocating the stem to reciprocate the bristles and the liquid during toothbrushing, b) the reciprocating effected at a frequency to effect dispersement and movement of the light-transmitting elements in the liquid, to be visible through the wall, c) and observing the elements in dispersed and moving condition, via the transparent wall.

With respect to the above description then, it is to be realized that the optimum dimensional relationships for the parts of the invention, to include variations in size, materials, shape, form, function, and manner of operation, assembly and use, are deemed readily apparent and obvious to one skilled in the art; and all equivalent relationships to those illustrated in the drawings and described in the specification, are intended to be encompassed by the present invention. In the highly advantageous and unusual form shown, the liquid-filled handle has length at least twice its width, and handle width is at least twice the width of stem 26, for firm control of the bristles during brushing, for high visibility of the light-transmitting elements or particles. The elements or particles are typically less than about ⅛ inch in cross dimension.

Therefore, the foregoing is considered as illustrative only of the principles of the invention. Further, since numerous modifications and changes will readily occur to those skilled in the art, it is not desired to limit the invention to the exact construction and operation shown and described; and accordingly, all suitable modifications and equivalents may be resorted to, falling within the scope of the invention.

I claim:

1. A decorative toothbrush for use in encouraging children to brush their teeth, the toothbrush comprising, in combination:

a) a brush component having a proximal end, a distal end, and an intermediate extent therebetween, the distal end having a generally rectangular configuration, and a first coupling part at the proximal end of the brush component, b) bristles carried proximate the distal end of the brush component, c) a handle component having a proximal end, a distal end and an intermediate extent therebetween, the handle component being constructed from a transparent plastic material and having a hollow interior portion, d) a second coupling part at the proximal end of the handle component, said coupling parts adapted to be removably coupled together, to thereby couple the proximal end of the brush component to the proximal end of the handle component, and e) a decorative fluid positioned within the hollow interior of the handle component, the decorative fluid containing a plurality of dispersible elements, including particles which are light transmitting and which provide glowing appearance in the dark, the elements being suspended within the fluid, to move about during brush reciprocation.

2. The decorative toothbrush as described in claim 1, wherein the elements are suspended in a glycerin-water mixture.

3. The decorative toothbrush, as described in claim 1, wherein the elements include reflective elements suspended in water.

4. The decorative toothbrush, as described in claim 1, wherein the elements include reflective elements suspended in a glycerin-water mixture.

5. A decorative toothbrush for use in encouraging children to brush their teeth, the toothbrush comprising, in combination:

a) a brush component having a proximal end, a distal end, and an intermediate extent therebetween, the distal end having a generally rectangular configuration, and a first coupling part at the proximal end of the brush component, b) bristles carried proximate the distal end of the brush component, c) a handle component having a proximal end, a distal end and an intermediate extent therebetween, the handle component being constructed from a transparent plastic material and having a hollow interior portion, d) a second coupling part at the proximal end of the handle component, said coupling parts adapted to be removably coupled together, to thereby couple the proximal end of the brush component to the proximal end of the handle component, and e) a decorative fluid positioned within the hollow interior of the handle component, the decorative fluid containing a plurality of dispersible elements, which are light transmitting, the elements being suspended within the fluid, to move about during brush reciprocation, f) said elements being three dimensional elements molded from phosphorescent material.

6. A decorative toothbrush for use in encouraging children to brush their teeth, the toothbrush comprising, in combination:

a) a brush component having a proximal end, a distal end, and an intermediate extent therebetween, b) a series of bristles secured to and extending upward form the distal end of the brush component, c) a handle component having a proximal end, a distal end, and an intermediate extent therebetween, the handle component being constructed from a transparent material and having a hollow interior portion, d) the proximal end of the brush component being joined to the proximal end of the handle component, e) a decorative fluid positioned within the hollow interior of the handle component, there being light-transmitting elements including elements that provide glowing appearance in the dark, said elements dispersed in said fluid, to move about in response to use of the toothbrush.

7. The decorative toothbrush, as described in claim 6, wherein the elements are suspended in said fluid which comprises water.

8. The decorative toothbrush, as described in claim 6, wherein the elements are suspended in said fluid which comprises a glycerin-water mixture.

9. A decorative toothbrush for use in encouraging children to brush their teeth, the toothbrush comprising, in combination:

a) a brush component having a proximal end, a distal end, and an intermediate extent therebetween, the distal end having a generally rectangular configuration, and a first coupling part at the proximal end of the brush component, b) bristles carried proximate the distal end of the brush component, c) a handle component having a proximal end, a distal end and an intermediate extent therebetween, the handle component being constructed from a transparent plastic material and having a hollow interior portion, d) a second coupling part at the proximal end of the handle component, said coupling parts adapted to be removably coupled together, to thereby couple the proximal end of the brush component to the proximal end of the handle component, and e) a decorative fluid positioned within the hollow interior of the handle component, the decorative fluid containing a plurality of dispersible elements, which are light transmitting, the elements being suspended within the fluid, to move about during brush reciprocation, f) and wherein the elements comprise a plurality of three-dimensional elements, each being phosphorescent.

10. A decorative toothbrush for use in encouraging children to brush their teeth, the toothbrush comprising, in combination:

a) a brush component having a proximal end, a distal end, and an intermediate extent therebetween, the distal end having a generally rectangular configuration, and a first coupling part at the proximal end of the brush component, b) bristles carried proximate the distal end of the brush component, c) a handle component having a proximal end, a distal end and an intermediate extent therebetween, the handle component being constructed from a transparent plastic material and having a hollow interior portion, d) a second coupling part at the proximal end of the handle component, said coupling parts adapted to be removably coupled together, to thereby couple the proximal end of the brush component to the proximal end of the handle component, and e) a decorative fluid positioned within the hollow interior of the handle component, the decorative fluid containing a plurality of dispersible elements, which are light transmitting, the elements being suspended within the fluid, to move about during brush reciprocation, f) and wherein the elements comprise a plurality of three-dimensional elements, each being phosphorescent, the elements being suspended in said fluid which includes a glycerin-water mixture.

* * * * *